US007198097B2

(12) United States Patent
Powers et al.

(10) Patent No.: US 7,198,097 B2
(45) Date of Patent: Apr. 3, 2007

(54) ANGLED RIBS FOR HEAT EXCHANGER TANKS

(75) Inventors: Michael Powers, Lakewood, NY (US); Scot Carapellatti, Olean, NY (US)

(73) Assignee: Valeo, Inc., Auburn Hills, MI (US)

( * ) Notice: Subject to any disclaimer, the term of this patent is extended or adjusted under 35 U.S.C. 154(b) by 384 days.

(21) Appl. No.: 10/739,862

(22) Filed: Dec. 18, 2003

(65) Prior Publication Data

US 2005/0133213 A1 Jun. 23, 2005

(51) Int. Cl.
*F28F 9/02* (2006.01)

(52) U.S. Cl. ..... 165/173; 165/906

(58) Field of Classification Search ..... 165/173, 165/906

See application file for complete search history.

(56) References Cited

U.S. PATENT DOCUMENTS

| | | | | |
|---|---|---|---|---|
| 2,425,215 | A * | 8/1947 | West | 15/45.1 |
| 4,331,201 | A * | 5/1982 | Hesse | 165/153 |
| 4,940,086 | A | 7/1990 | Stay | |
| 5,107,924 | A * | 4/1992 | Herbert et al. | 165/173 |
| 5,195,581 | A * | 3/1993 | Puntambekar et al. | 165/173 |
| 5,316,420 | A * | 5/1994 | Watanabe et al. | 409/190 |
| 6,082,446 | A * | 7/2000 | Ahaus et al. | 165/173 |
| 6,679,310 | B2 * | 1/2004 | De Zen | 160/229.1 |
| 2003/0141047 | A1 * | 7/2003 | Lamich | 165/173 |
| 2003/0205367 | A1 * | 11/2003 | Shields et al. | 165/173 |
| 2004/0265536 | A1 * | 12/2004 | Sana et al. | 428/119 |

FOREIGN PATENT DOCUMENTS

| | | | |
|---|---|---|---|
| DE | 199 26 052 | A1 | 12/2000 |
| DE | 201 21 112 | U1 | 4/2003 |
| EP | 256913 | A1 * | 2/1988 |
| EP | 1 191 298 | A | 3/2002 |
| FR | 2 249 300 | A | 5/1975 |
| FR | 2440831 | * | 6/1980 |
| JP | 11 281293 | A | 10/1999 |

* cited by examiner

*Primary Examiner*—Allen J. Flanigan
(74) *Attorney, Agent, or Firm*—Ronald Courtney

(57) ABSTRACT

The present invention relates to the field of automotive heat exchangers, and, in particular, to ribbed heat exchanger tanks. This invention uses ribs that are oriented perpendicular to the local wall bending axes, and, therefore, not necessarily perpendicular to or parallel with the plane of the header to improve resistance to thereby reduce wall deflection and reduce stress concentration in or near the ribs.

15 Claims, 15 Drawing Sheets

ANGLED RIBS FOR HEAT EXCHANGER TANKS

FIELD OF INVENTION

The present invention relates to the field of automotive heat exchangers, and, in particular, to ribbed heat exchanger tanks.

BACKGROUND OF THE INVENTION

Motor vehicles employ heat exchangers to heat or cool various elements of an automotive engine and its component parts. Heat exchangers generally have a body part for exchange and may have heat exchanger tank parts, which can be described as being exchanger tanks which typically include a coolant and require a fluid tight seal. Heat exchanger tanks may be made of a variety of materials, depending on the strength and/or temperature requirements imposed upon them in automotive applications. Plastic tanks have been utilized in heat exchangers and have proven to reduce weight while providing good thermal and strength characteristics in a number of applications. Plastic header tanks, for example, as described in U.S. Patent publication No. US0141047A1, Lamick, published Jul. 31, 2003. However, due to the strict requirements imposed upon use of such tank parts in automotive applications, designs for plastic heat exchanger tank parts also use reinforcing ribs to enhance structural integrity and rigidity. In particular, these reinforcing ribs are normally oriented perpendicular or parallel to the plane of the header to achieve the desired characteristics. Ribs provide reinforcement by increasing the moment of inertia of the wall section where they are located. FIG. 1 shows a rib pattern typical in the prior art. Prior art designs, such as in FIG. 1, have been used for plastic heat exchanger radiator tank parts, with operating pressures high to low. In terms of fluid flow, however, the prior art designs are far from optimal to resist moderate to high operating pressures, particularly with their square or rectangular profile walls. Also, in automotive radiators, tanks with sidewalls that are essentially rectangular or uniform are often utilized.

Another, and, sometimes complementary solution to the reinforcing ribs of the prior art is to improve flow characteristics (pressure loss and flow distribution) by increasing flow area: this by increasing the tank part sidewall height. However, this has often led to the disadvantageous requirement for cross-ribs (i.e. ribs basically parallel to the header plane in many automotive applications) in the heat exchanger tank, particularly since the spacing between the tank foot and top wall bend (and hence the length of unsupported wall) necessarily increases. The potential solution of increasing sidewall height to deal with high pressure considerations also may disadvantageously complicate the molding process of the tank, since the mold tool cannot be simply removed in a direction perpendicular to the header unless all sidewall ribs are also perpendicular to the header.

Therefore, though increasing the sidewall height while maintaining a rectangular, i.e. uniform, profile would reduce pressure losses, the result is excessive tank volume near the ends. Excess tank volume is also known to degrade the transient response of the intake system (so called "turbo lag"). This solution is also not optimal from a materials and packaging standpoint.

The present invention overcomes these design weaknesses. By providing increased wall stiffening, the present invention is feasible in most all heat exchanger tank environments. The present invention has even further advantages as it relates to heat exchangers when fluid flow involves lower density liquids or where operating pressures are greater than moderate or even high to very high.

SUMMARY OF THE INVENTION

The present invention, therefore provides a heat exchanger comprising a heat exchanger body part and a heat exchanger tank part, the heat exchanger tank part comprising a non-uniform section and, potentially, a uniform section, the tank part having a rib pattern, which, compared to the prior art cited above, optimizes preferred characteristics of the tank and preferably those comprising synthetic resin, plastic or plastic-like materials, wherein less material is necessary to achieve the same level of strength without the need for increasing wall thickness or rib density. By providing for ribs that follow, tank boundaries or structural features the present invention solves the problem of structural integrity and durability in a surprisingly efficient manner.

The present invention relates to a heat exchanger for use in automotive applications, particular those uses in higher pressure internal environments, comprising a heat exchanger body part and a heat exchanger tank part, wherein there exists at least one non-uniform section of the heat exchange tank, and wherein the non-uniform section of the heat exchanger tank part is reinforced by the presence of at least one rib or ribs in a particular pattern. Preferred embodiments of the present invention include at least one rib, more preferred, a number of ribs, wherein at least one rib is an angled rib. In preferred embodiments of the present invention, ribs that are oriented perpendicular to the local wall bending axes ('angled ribs'), and, therefore, not necessarily perpendicular to or parallel with the plane of the header ('non-angled ribs'), are present. Also in preferred embodiments, at least one rib is a non-angled rib either in a transition zone of the heat exchanger tank or in a uniform section of the heat exchanger tank. Ribs are commonly used in structural plates or walls to add strength and rigidity by increasing the moment of inertia of the wall section. Ribs, or locally thick wall sections, increase bending stiffness compared to a flat plate of the same uniform base thickness. Ribs may be made of any suitable material. Preferably, ribs comprise materials similar or identical to the tank materials. Also, preferably ribs comprise plastic or plastic-like material. Properly designed ribs provide greater stiffness per unit weight of material compared to a solid wall, and improve molding characteristics by avoiding thick sections of solid material.

One of the advantageous aspects of the present invention is that its required angle of orientation improves resistance to bending, which reduces wall deflection and stress concentrations in or near the ribs. The present invention further relates to method of making heat exchangers with angled ribs wherein the synthetic resin, plastic or plastic-like materials is injected or 'flows' such that the fibers, if present, are aligned to follow the flow along the line of the ribs.

Optimizing the orientation of tank wall ribbing by aligning ribs perpendicular to local wall bending axes will provide maximum resistance to bending for a particular rib shape and wall thickness.

Any moldable or castable material that provide adequate thermal and strength requirements for use in environment under such stresses will be understood by one of skill in the art to be capable of use to form tanks with angled ribs provided in the embodiment of the present invention. Preferred embodiments may comprise materials such as aluminum, die cast, carbon fibers with or without a 'plastic' base, composite materials such as nylon/glass, nylon/carbon, carbon/carbon or the like or synthetic resin or plastic and plastic-like materials. Plastic and plastic-like material preferably utilized in preferred embodiments of the present invention include non-limiting examples of plastic or plastic-like materials such as propylenes and polypropylenes, ethylenes and polyethylenes, vinyls and polyvinyls and the like and materials such as nylon (such as nylon 66) Ems PPA 45, Styrelene PPS 40, and the like.

The present invention, therefore, minimizes the amount of material required for a given level of tank wall stiffness and durability, while contributing to the overall design optimization of the tank and satisfying airflow, manufacturing and packaging requirements. The present invention also has the further advantage of reduced cost and improved durability and packaging over prior art solutions to weight and strength problems. This is especially true for the exterior tank wall but also has application to the interior walls. As described herein, the present invention, in its multiple aspects, provides increased wall stiffening, and makes its use feasible in most all heat exchanger tank environments, as well as in other conditions. The present invention has even further advantages as it relates to heat exchangers when fluid flow involves lower density liquids or where operating pressures are moderate, and, especially, high to very high.

In preferred embodiments, therefore, the present invention provides for a heat exchanger for use in automotive applications, particular those uses in higher pressure internal environments, comprising a heat exchanger body part and a heat exchanger tank part comprising a non-uniform section, wherein the heat exchanger tank part is reinforced by the presence of ribs in a particular pattern. Also preferred are heat exchangers wherein the heat exchanger tank part is largely non-uniform in height, and, more preferable, non rectangular or square in shape.

Even more preferred are heat exchangers wherein there exists a transition zone comprising at least one angled rib and at least one non-angled rib, wherein the angled rib and non angled rib transition between a non-uniform section and a uniform section of the heat exchanger tank part. Also preferred are embodiments of the present invention wherein the ribs follow heat exchanger tank part boundaries or structural features.

It has been found that in more preferred embodiments of the present invention between 5 and 50% of the total surface area of the heat exchanger tank part is covered by ribs. In further preferred embodiments, the ribs found normal to local bending axes approximately centered on the wall and to rigid or semi-rigid boundaries of the wall of the heat exchange tank part.

DETAILED DESCRIPTION OF THE PREFERRED EMBODIMENTS

In preferred embodiments of the present invention, the heat exchanger has a rib pattern that optimizes the preferred characteristics of the heat exchanger tank part. In particularly preferred embodiments of the present invention, the heat exchanger is selected from the group consisting of charge air coolers, after coolers and inter coolers.

Figure 1:
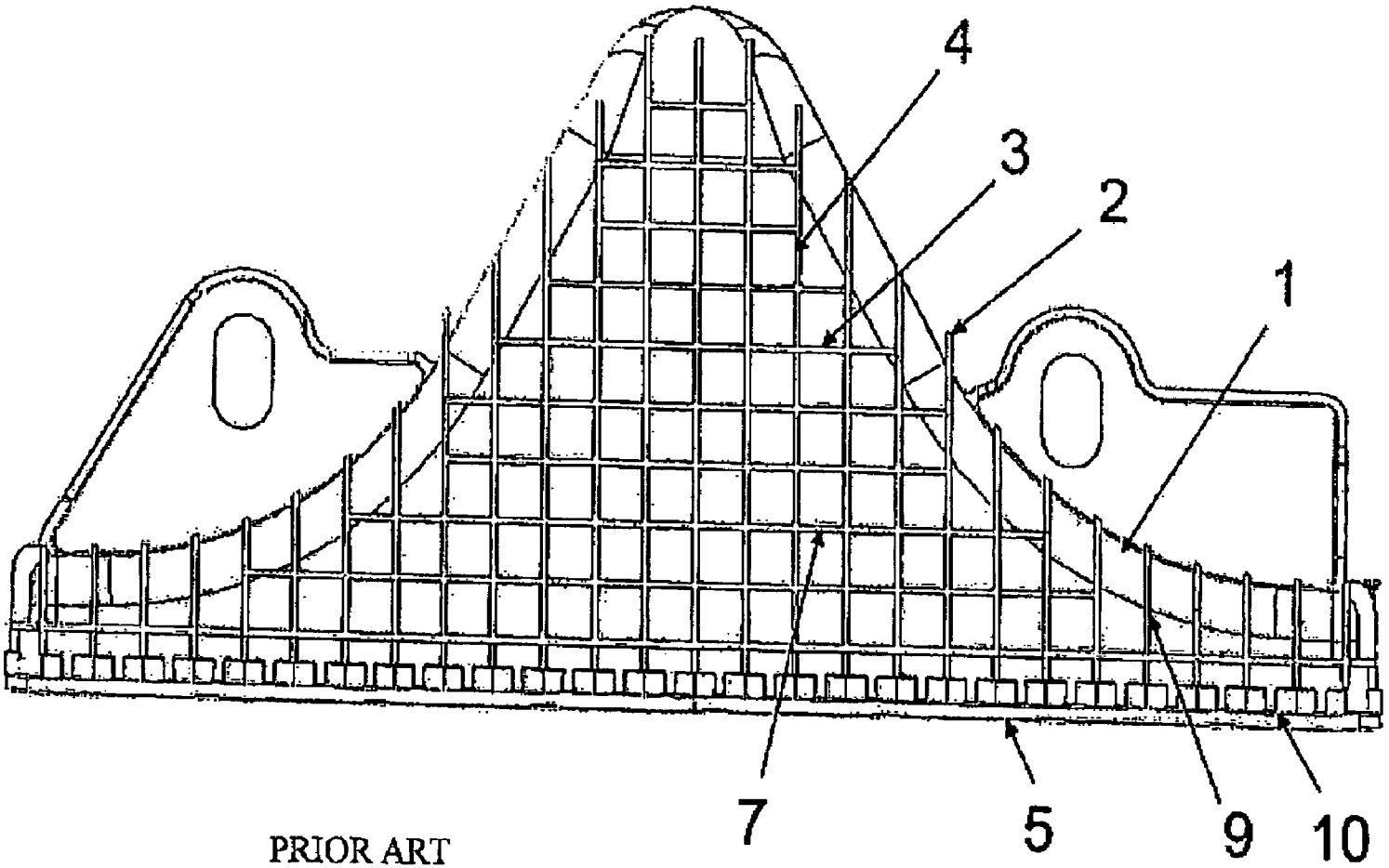
PRIOR ART FIG. 1
FIG. 1. Schematic representation of plastic tank wall reinforcing ribs as found in prior art designs.

Referring to FIG. 1, representing an exemplary reinforcing rib tank feature in the prior art, a tank wall 1 is provided with reinforcing ribs 2, 3, parallel and perpendicular 2, 4 to the header plane 5. Taller wall profile section 6 is provided with cross-ribs 7 parallel to the header plane 5. Shorter wall profile section 8 includes ribs 9 perpendicular to the header plane near the foot of the tank 10.

This type of design is typical in a low, rectangular profile heat exchanger tank often used in vehicle radiators, as well as other vehicle heat exchangers. In this design, ribs that are perpendicular to the header plane are used. Ribs that are parallel to the header (cross-ribs) are not generally required for low profile walls, since the tank foot and top wall bend act as stiffeners, and are relatively close together. In FIG. 1, cross-ribs 7 parallel to the header 5 are shown in the taller wall profile section 6. Ribs perpendicular to the header are seen and away from the tank foot. Wall profiles are thus rectangular or square.

In preferred aspects in accordance with the present invention, and especially where higher operating pressure conditions may exist, low profile and taller profile walls may independently or concurrently exist. In intercoolers, after coolers, or charge-air-coolers (CAC's) for example, high operating pressure conditions are found. In such applications, the present invention, in its various embodiments, solves the design problems hereinabove cited of the prior art. In CAC's, flow characteristics are extremely important since the fluid is low density. In general, low density fluids are more compressible than liquids, and, therefore, more difficult to pump. CAC's are subjected to higher operating pressures and temperatures versus those in other heat exchangers such as radiators. Also, the designs are optimized to reduce pressure loss when compared to other heat exchangers. In preferred heat exchangers in accordance with the present invention, the internal pressure environment exceeds about 0.5 bar.

In more preferred embodiments of the present invention, for optimal flow characteristics the sidewall should be taller near the neck, to better accommodate the total volume of flow. The sidewall can be lower towards the ends of the tank since the number of tubes being supplied (and hence the flow rate) diminishes along the tank. A tank, in accordance with more preferred embodiments of the present invention, are generally 'triangular' or 'trapezoidal', rather than rectangular in shape; in more preferred embodiments, such a profile provides for a more optimal fluid flow characteristic set (pressure loss, flow distribution, and transient response), and reduced packaging, and material cost.

In preferred embodiments of the present invention, the bending axis for a non-rectangular sidewall profile (e.g. tank with top walls not parallel to the header plane) will generally not be aligned with the header plane. Since using only ribs that are perpendicular to the header does not provide optimal resistance to bending, stress concentrations may be created in the ribs, particularly if cross-ribs parallel to the header are included. The preferred embodiments of the present invention, therefore, minimize stress concentration and provide resistance to bending at higher levels than found in the prior art hereindisclosed.

Figure 2:
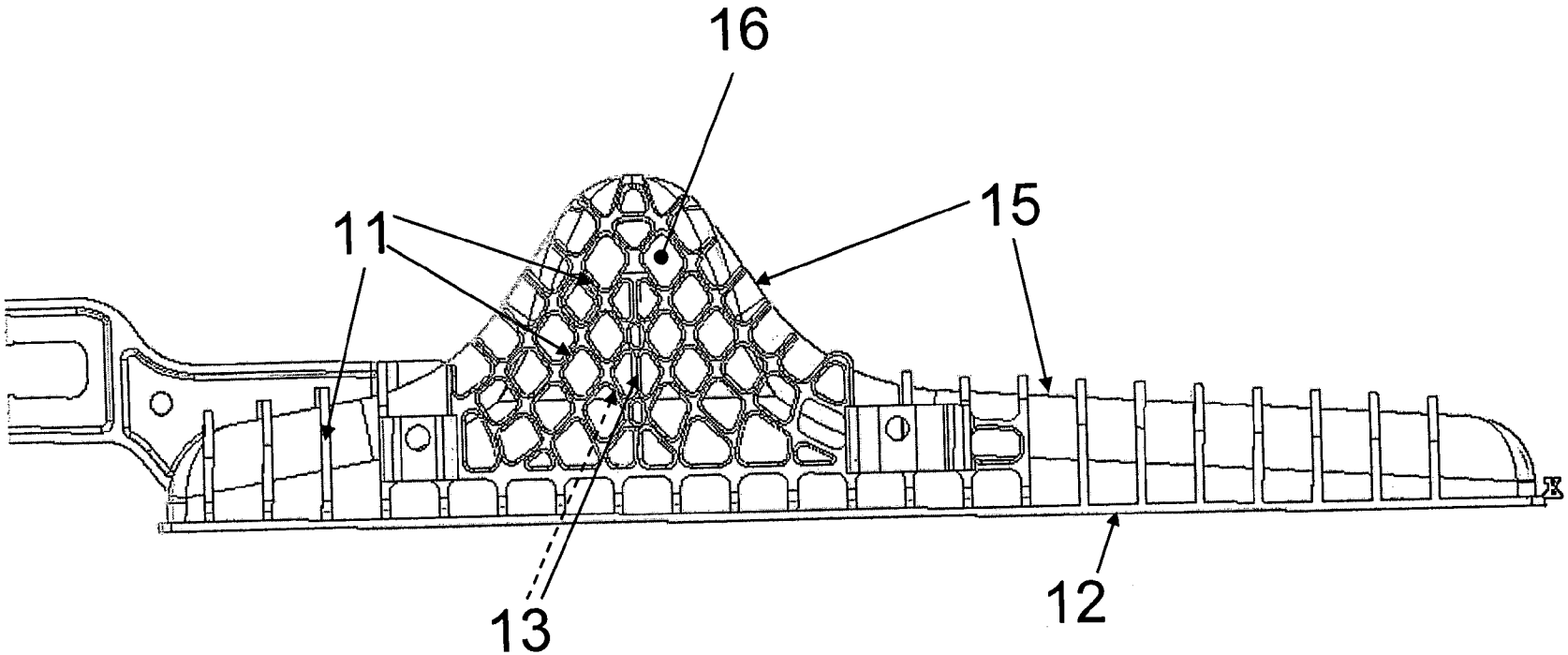
FIG. 2 Schematic representation of plastic tank wall with reinforcing ribs in accordance with an aspect of the present invention proposed design.

Referring to FIG. 2, in a preferred embodiment of the present invention, the ribs 11 of the tank 15 are oriented perpendicular to local wall bending axes (angled), in order to oppose sidewall 16 bending at every location. The wall profiles 13 are non-rectangular. Since ribs are angled based on the local wall bending axes, they are essentially not parallel to the header plane 12 or perpendicular and parallel to the header plane 12.

Figure 3:
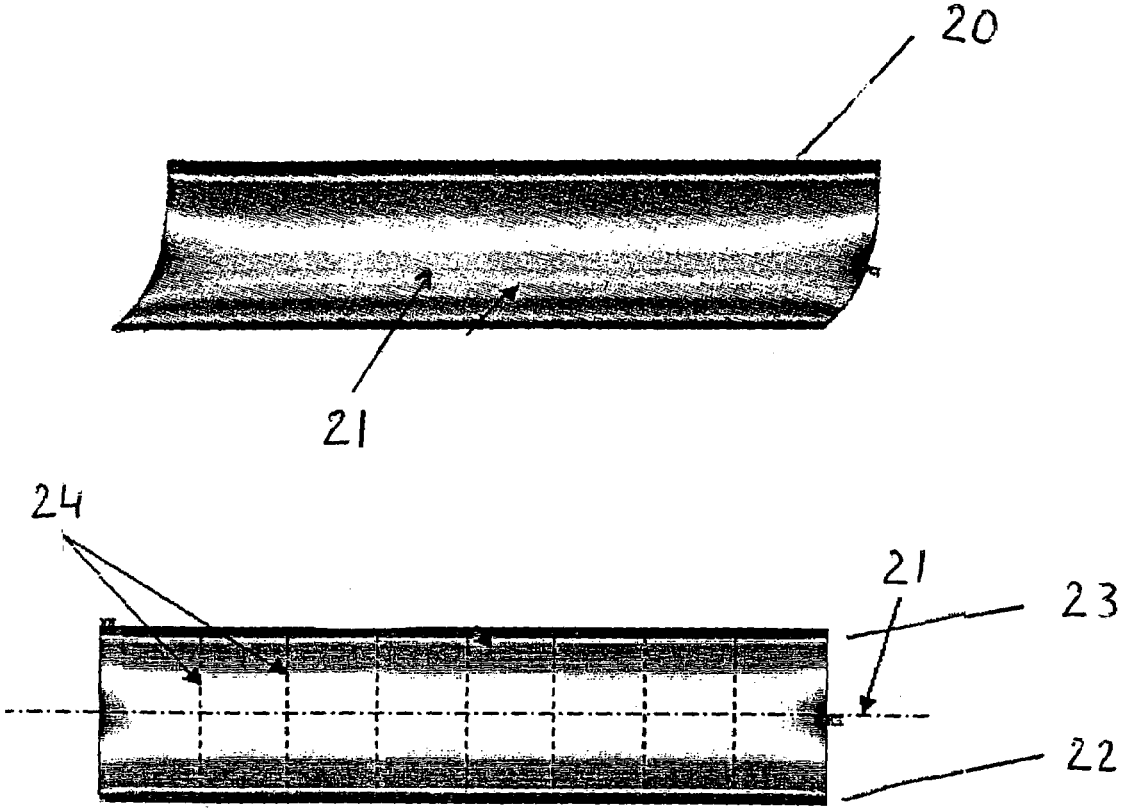
FIG. 3. Schematic representation of deformation results finite element analysis describing a simple rectangular plate or wall with wall bending axis.

FIG. 3 describes such a simple rectangular plate that is supported at the edges and uniformly loaded will have a bending axis aligned with the long edges of the plate. A simple rectangular plate or wall 20 with a bending axis 21 parallel with the two long edges 23,22. Angled ribs, in accordance with the present invention, are oriented to 'oppose' bending or, in other words, perpendicular 24 to the bending axis 21. The effective bending axes can be represented by a curve that is tangent to the local bending axis everywhere on the wall. Wall ribbing should generally be aligned to resist bending, or perpendicular to the axis of bending.

Figure 4A:
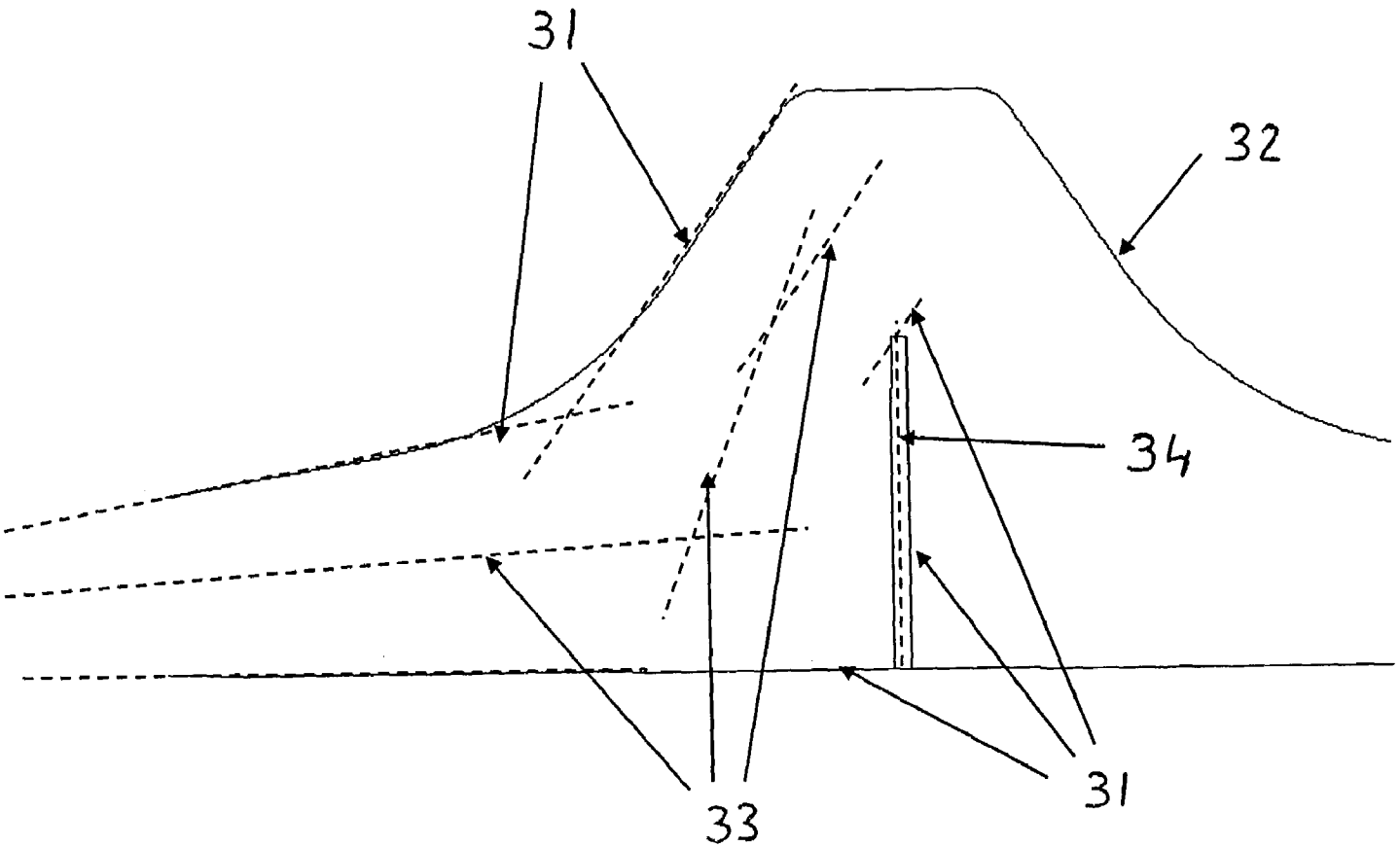
FIG. 4*a*. Graphic representation of tank wall profile with approximate wall bending axes.

Referring to FIGS. 4*a*–*d*, the curves for the approximate local wall bending axes can be developed. As can be seen in the figures, cross-ribs in accordance with an aspect of the present invention are not oriented parallel to the header, and they are away from the tank foot. The wall profiles are thus neither rectangular nor square in shape. In FIG. 4*a*, primary bending axes of a charge air cooler header tank are depicted. Dotted lines 31 represent rigid boundaries that follow the tank outline 32, and those of an internal wall tie 34. Dotted lines 33 represent the approximate wall bending axes that basically bisect the rigid boundaries, the entire graphic representation, therefore, representing an overall tank wall profile with approximate wall bending axes.

Figure 4B:
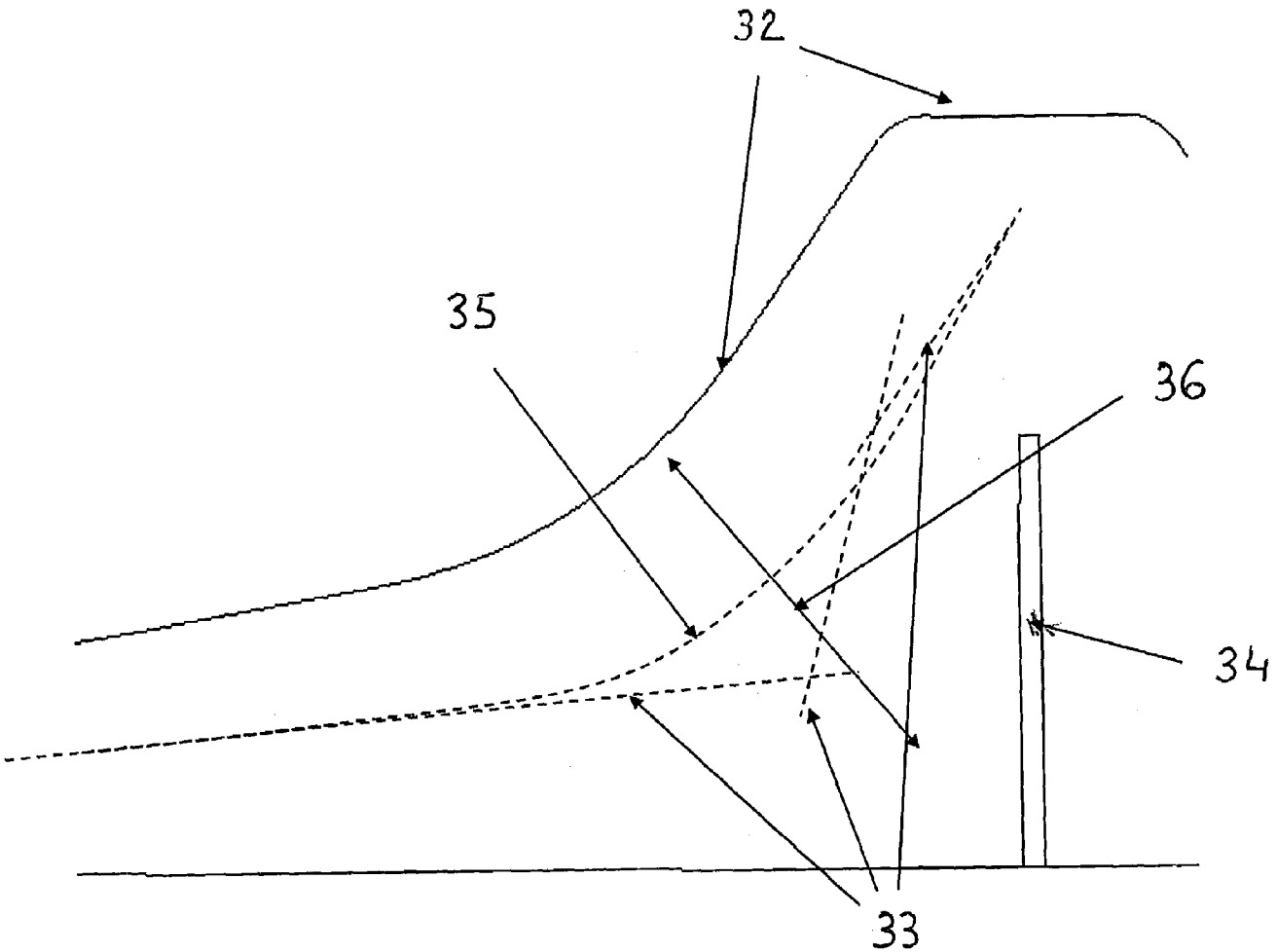
FIG. 4*b*. Graphic representation of smoothed curve tangent to approximate wall local bending axes.
Figure 4C:
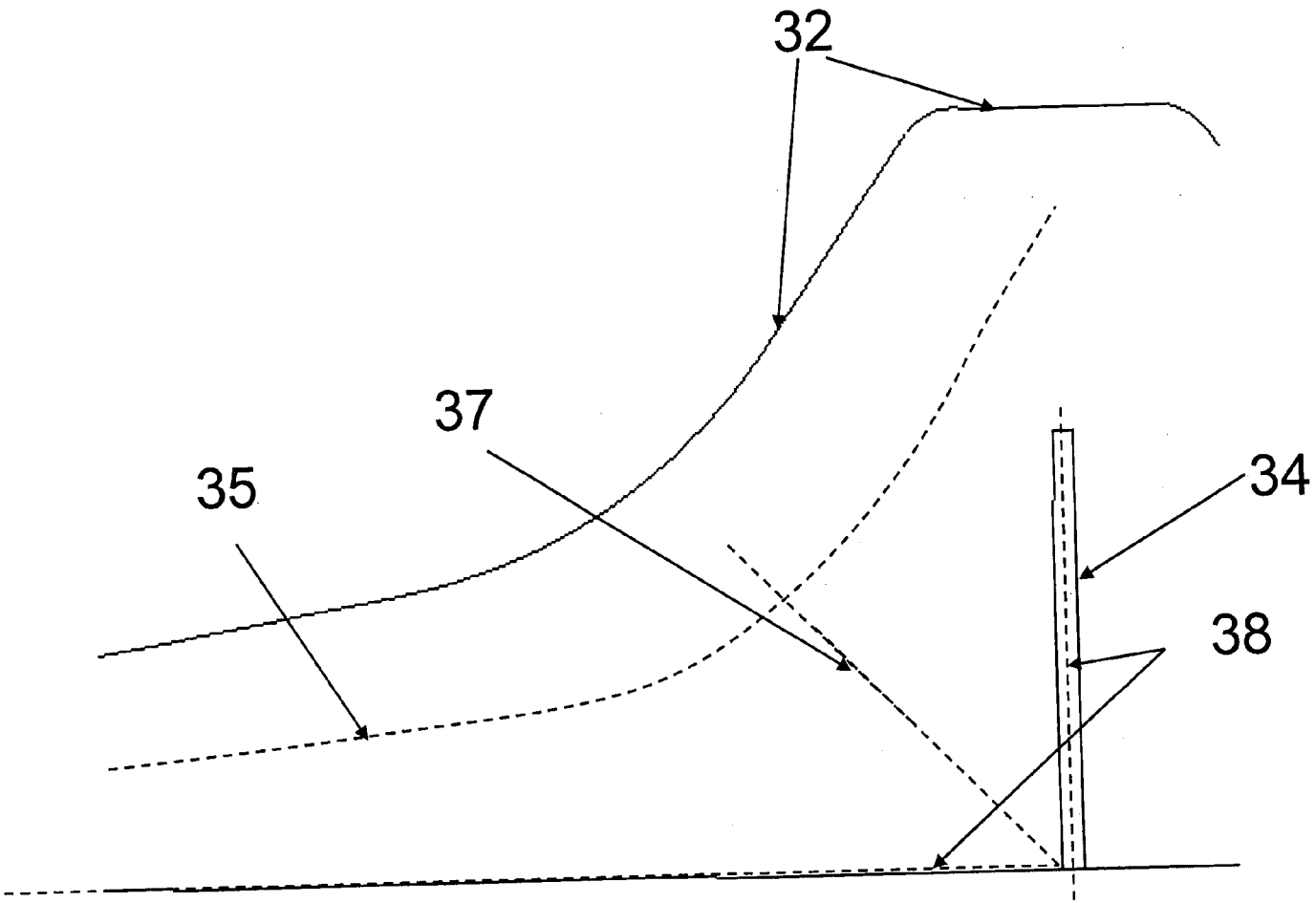
FIG. 4*c*. Graphic representation of curve tangent to approximate secondary wall local bending axes.

Referring to FIG. 4*b*, tank outline 32 is shown, with dotted lines 33 representing the approximate wall bending axes that basically bisect the rigid boundaries, and line 35 indicating the approximate smooth curve tangent to local bending axes. Line 36 represents the approximate dimension of supported wall. Referring to FIG. 4*c*, the tank outline 32 is shown, with approximate curve tangent to primary wall local bending axis line 35 intersecting with the approximate curve tangent to secondary wall local bending axis line 37 and close to wall bending axis basically bisecting rigid boundaries line 38. The entire graphic representation, therefore, showing the curves tangent to the primary and secondary wall bending axes.

Figure 4D:
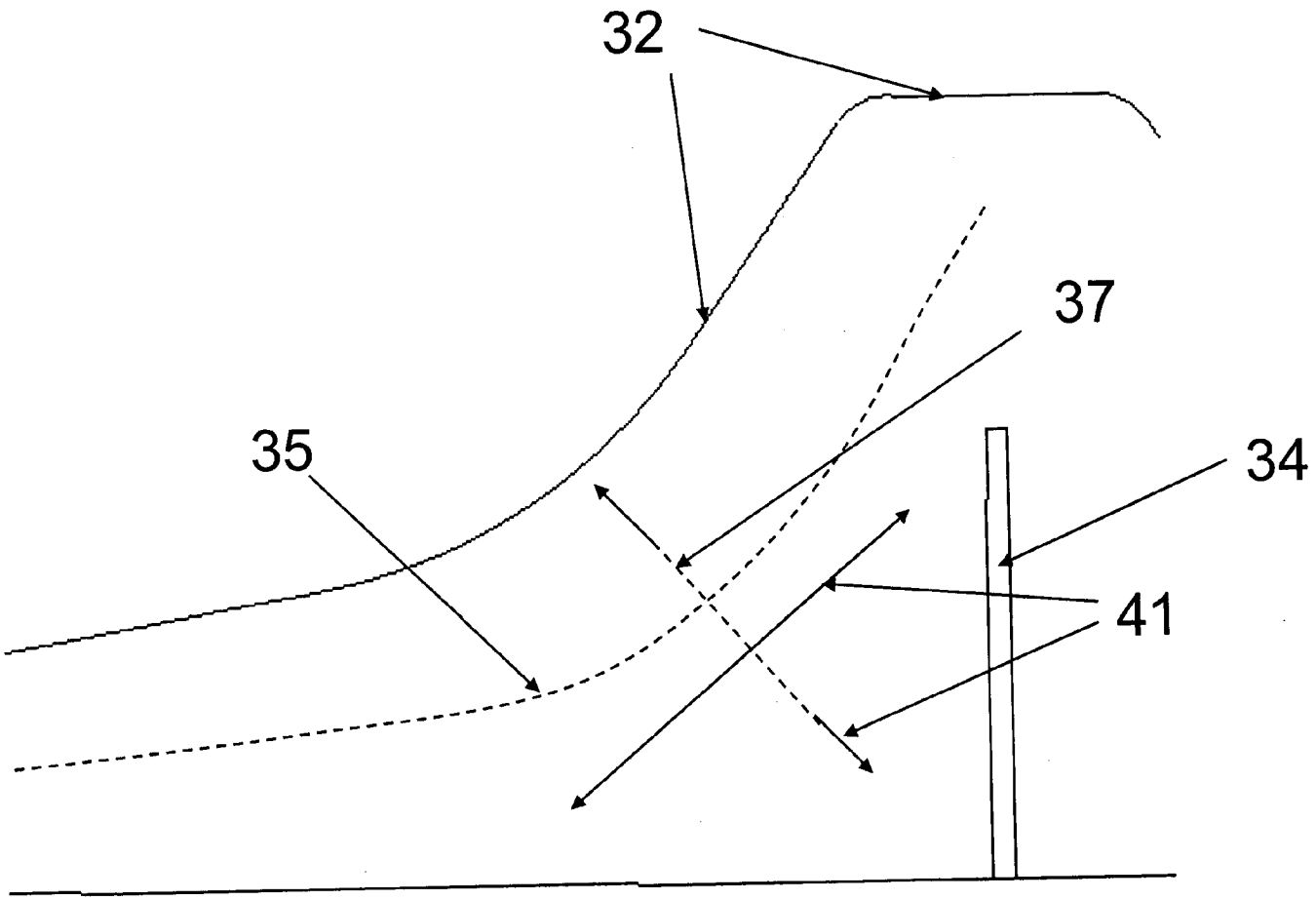
FIG. 4*d*. Graphic representation of wall bending axes and unsupported wall.

Referring to FIG. 4*d*, tank outline 32, smoothed curve tangent to local bending axes line 35 and curve tangent to secondary wall local bending axis line 37 are shown. Lines 41 represent the approximate dimension of unsupported wall, i.e. where ribs are needed to provide 'stiffening' characteristics. The entire graphic representation, therefore, shows both wall bending axes and unsupported wall elements.

Figure 5:
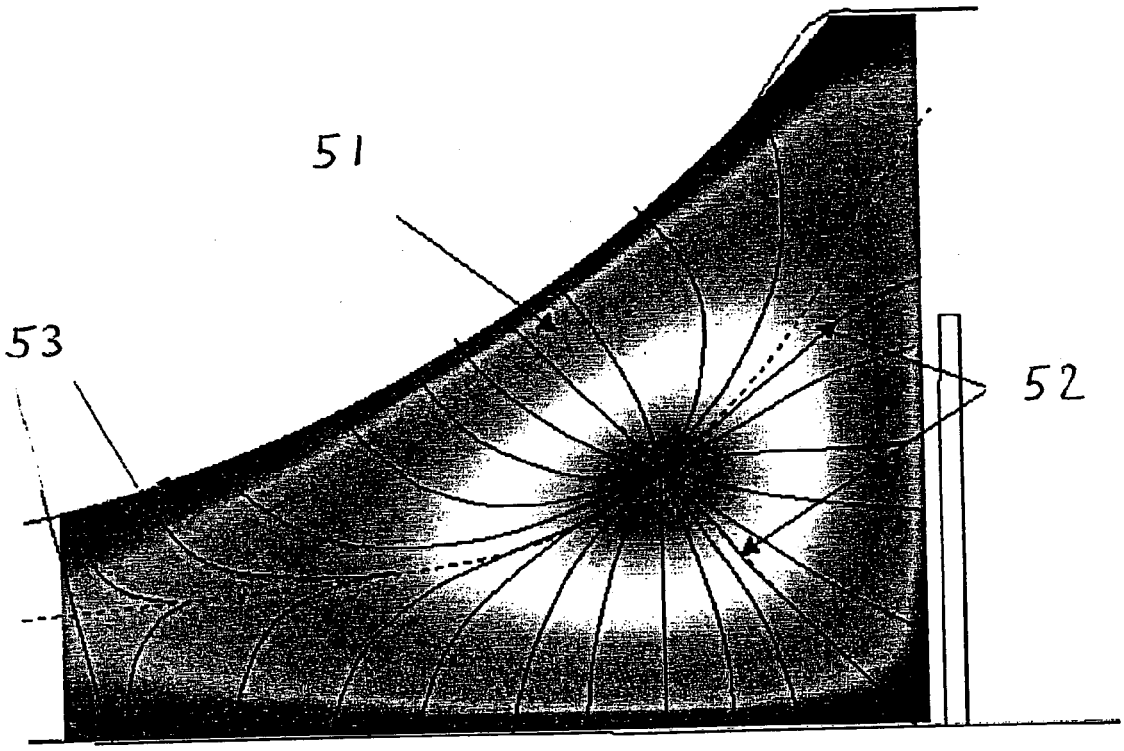
FIG. 5. Finite element analysis (FEA) deformation results and ideal rib orientation.
Figure 6:
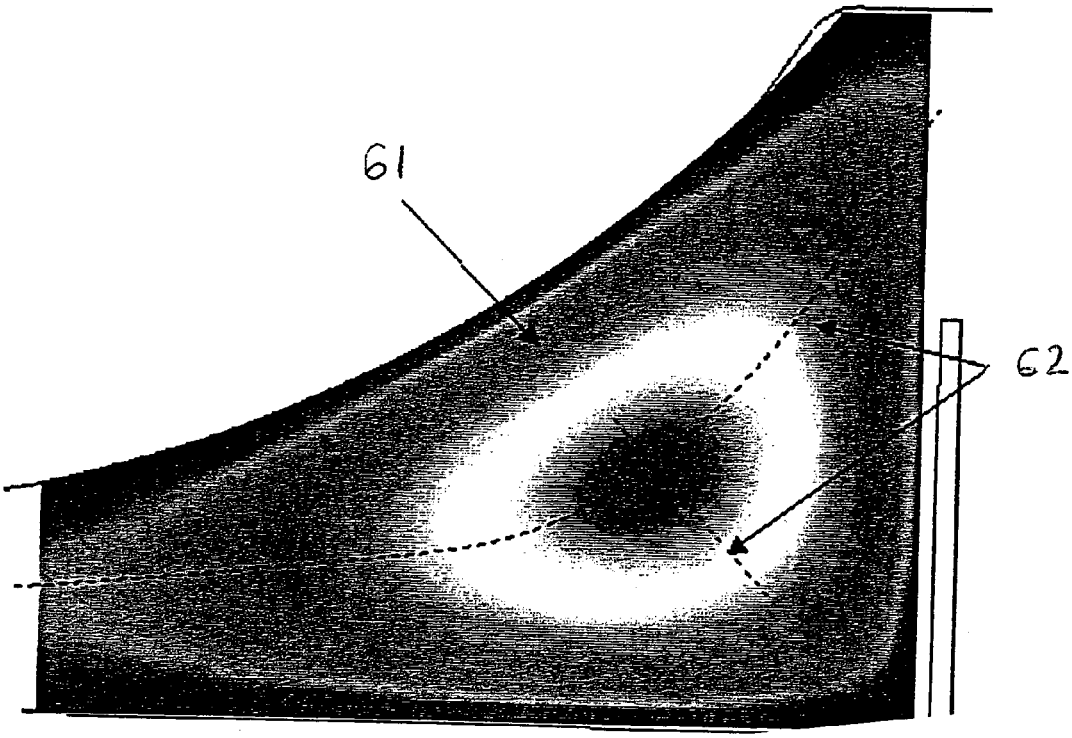
FIG. 6. FEA deformation results and simplified rib orientation in accordance with an aspect of the present invention.
Figure 7:
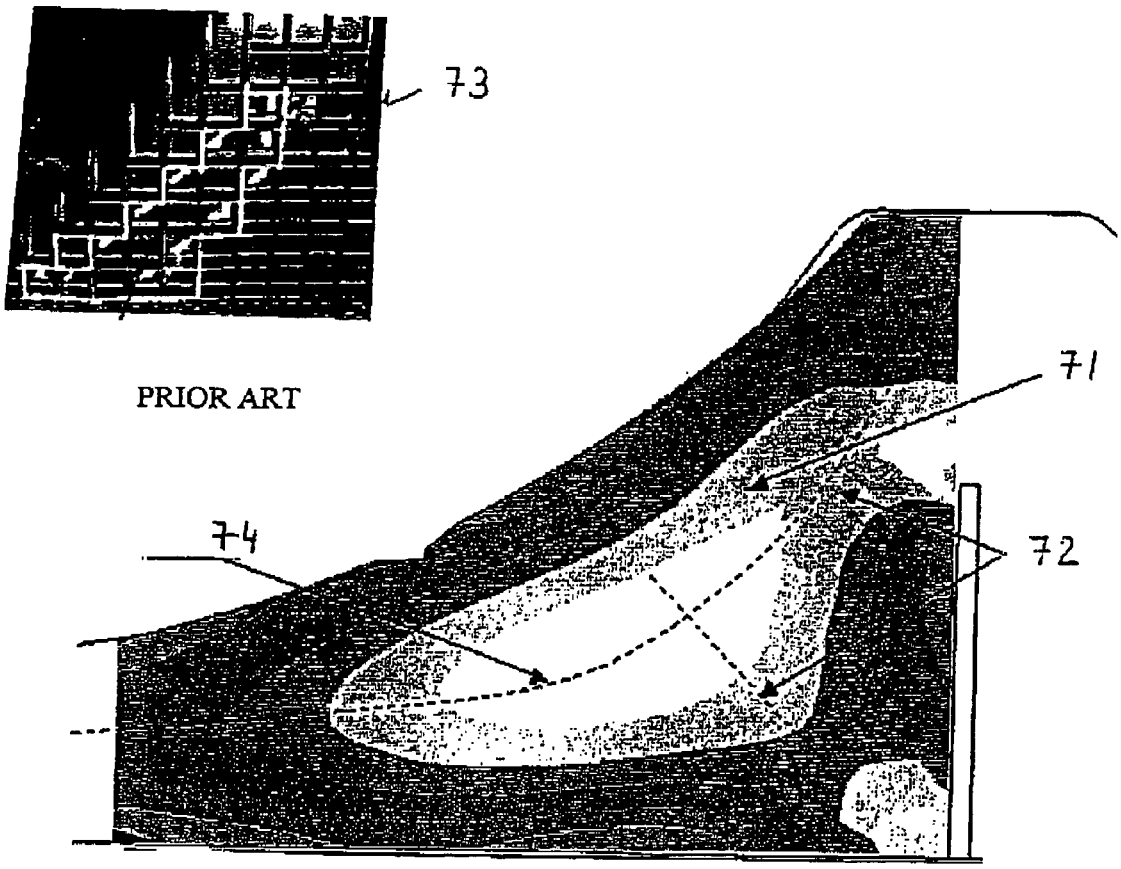
FIG. 7. Graphic representation of FEA stress results of angled ribs design in accordance with an aspect of the present invention and a prior art design.

FIGS. 5 to 7 show a more precise and rigorous approach to defining the rib pattern via numerical or finite element analysis. In general, in the present invention, the local bending axis is used to locate ribs tangent to lines of constant deflection. Preferably, at least one angled rib is provided which is perpendicular to or normal to contour lines of constant deflection. In heat exchanger tank parts in conformance with an aspect of the present invention, the rib pattern has ribs normal to local bending axes approximately centered on the tank wall or rigid or to rigid or semi-rigid boundaries of the wall of the heat exchange tank part. In more preferred embodiments, there exists at least one transition zone on the tank wall comprising at least one angled rib and at least one non-angled rib, wherein the angled rib and non-angled rib transition between a non-uniform section and a uniform section of the heat exchanger tank. The contours of constant deflection as determined from Finite Element Analysis (FEA) are shown in FIGS. 5 and 6 along with lines perpendicular to the deflection iso-contours. In more preferred embodiments, the lines represent the rib pattern for the flat wall, with a minimum of external support at the edges, while applying uniform pressure.

FIG. 5 shows overall contours of constant deformation, and, particularly, deformation area 51 from finite element analysis for a simplied, flat wall structure. Tangents to the local wall bending axes are shown as lines 52, with edges 53 constrained in translation, but free to rotate about lines 53.

FIG. 6 shows deformation results with a simplified rib orientation model wherein deformation results from finite element analysis for the simplified flat wall are in deformation area 61, and two representative curves 62 are utilized for the rib pattern that coincide with curves tangent to local bending axes.

In summary, FIG. 7 illustrates overall stress results from the FEA model, along with an example of a prior art design, which developed a 'crack' during pressure cycling. The crack forms along a line roughly corresponding to the high stress region of the flat wall. The crack in the prior art design intersects the cross-ribs at approximately 45 degrees. This prior art design demonstrates that rib orientation in such a design is far from optimal and distinguishably different from the angled ribs oriented perpendicular to a potential line of crack propagation, in accordance with an aspect of the present invention.

In more detail, FIG. 7 shows FEA stress results versus a prior art design in graphic form. Stress results from finite element analysis for simplified flat wall are show in area 71, with the tangent to the local wall bending axes 72 illustrated along with the contours of constant stress. The prior art depiction 73 demonstrates cracks 74 forming along the bending axis during tests, as they do not conform with the angled ribs of the present invention.

Figure 8:
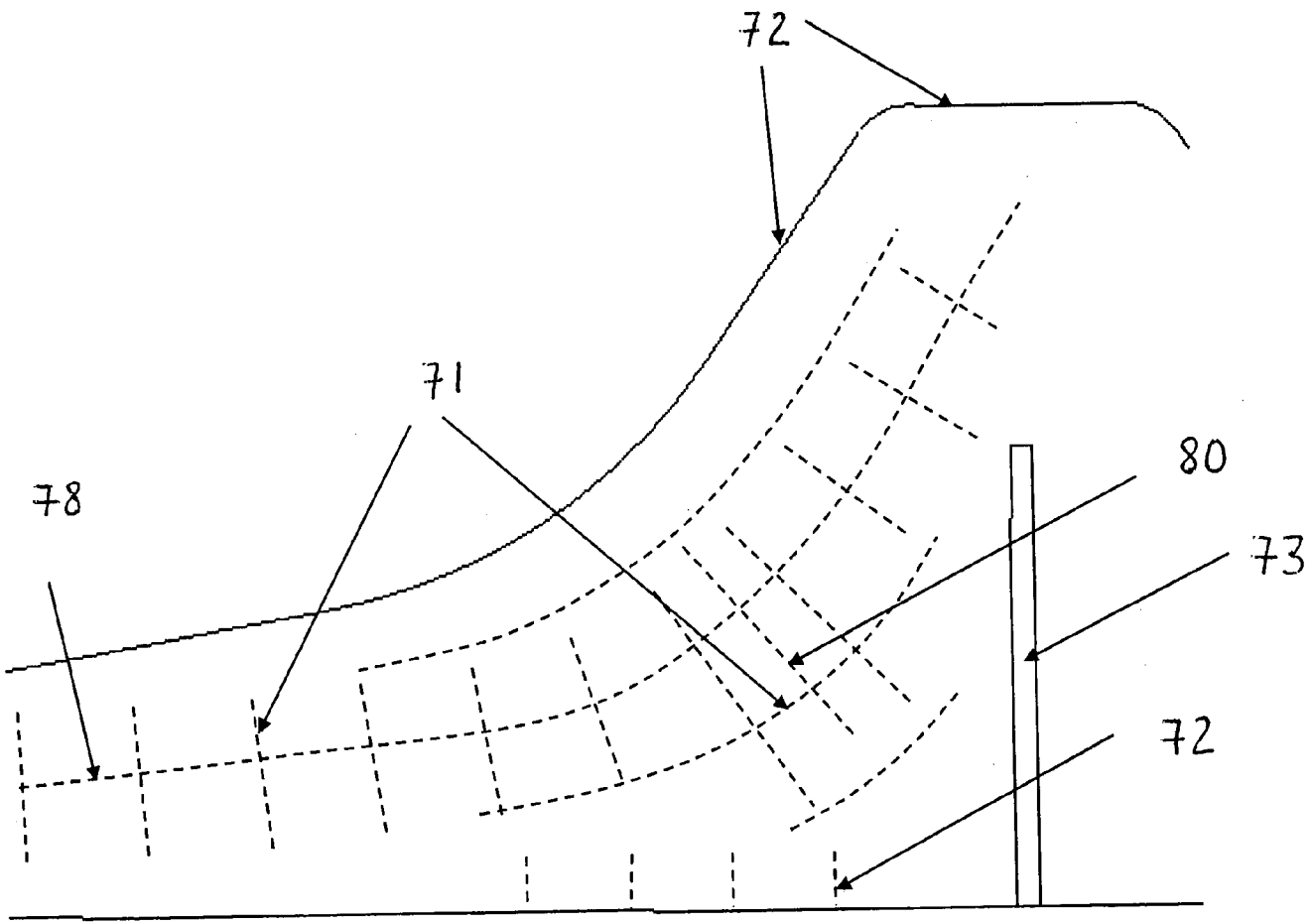
FIG. 8. Graphic representation of rib orientation in a design in accordance with an aspect of the present invention.

FIG. 8 schematically shows a cross-rib pattern in accordance with an aspect of the present invention. By providing 'angled' ribs (ribs oriented essentially perpendicular to local bending axes), maximum resistance to bending is achieved, while utilizing a minimum of material for strength and rigidity. In more detail, FIG. 8 again shows the tank outline 72 where ribs should be oriented perpendicular to local bending axes for maximum resistance to bending 71 and the approximate curve tangent to primary wall local bending axes 78 and the approximate curve tangent to secondary wall local bending axes 80, wherein the description of rib orientation for the design in accordance with an aspect of the present invention shows the ribs 72 that preferably transition to be perpendicular to boundaries and an internal wall tie 73.

Ribs, in accordance with the present invention, do, necessarily, have finite widths. The rib pattern should approach, as nearly as possible, the most preferred rib pattern, while recognizing that actual structural features and loads must be considered in determining rib design.

Since angled ribs, in accordance with preferred embodiments of the present invention, will tend to coalesce near the center of the wall some engineering judgment must be used in laying out the pattern, but, in general, two major sets of deflection iso-contours can be identified.

FIG. 8 shows an example of a primary and secondary tangent-axis curve, in accordance with an aspect of the present invention that can be determined between these two sets of lines. Alternatively, the optimal rib orientation can be described in terms of stress components (principal stresses) rather than bending axis and deformations.

Figure 9A:
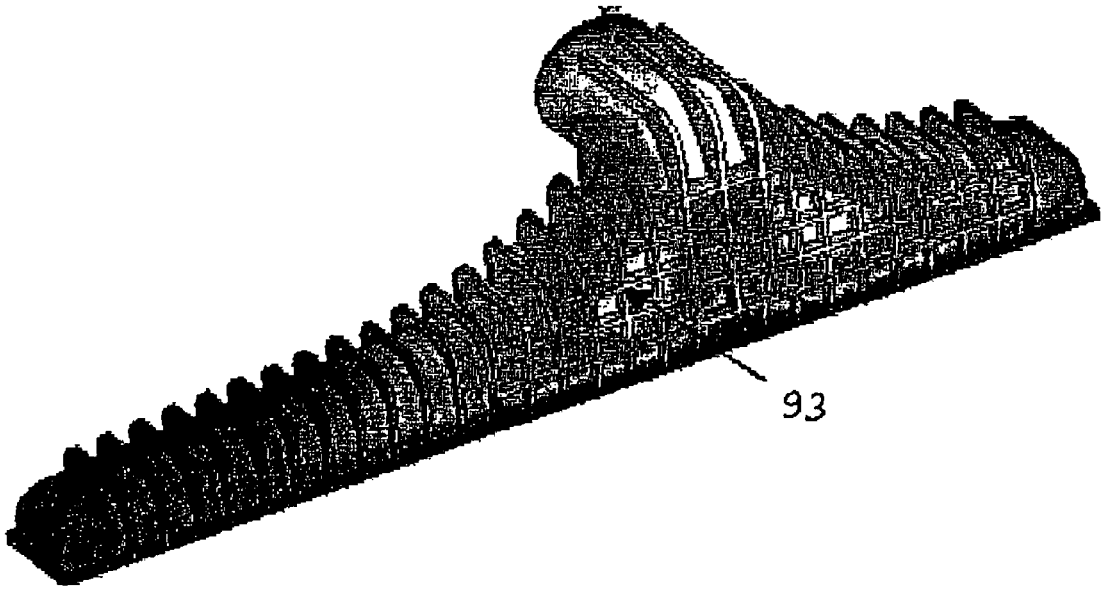
PRIOR ART FIG. 9a
FIGS. 9*a* and 9*b*. FEA deformation results comparing a design in accordance with an aspect of the present invention and a prior art design.
Figure 9B:
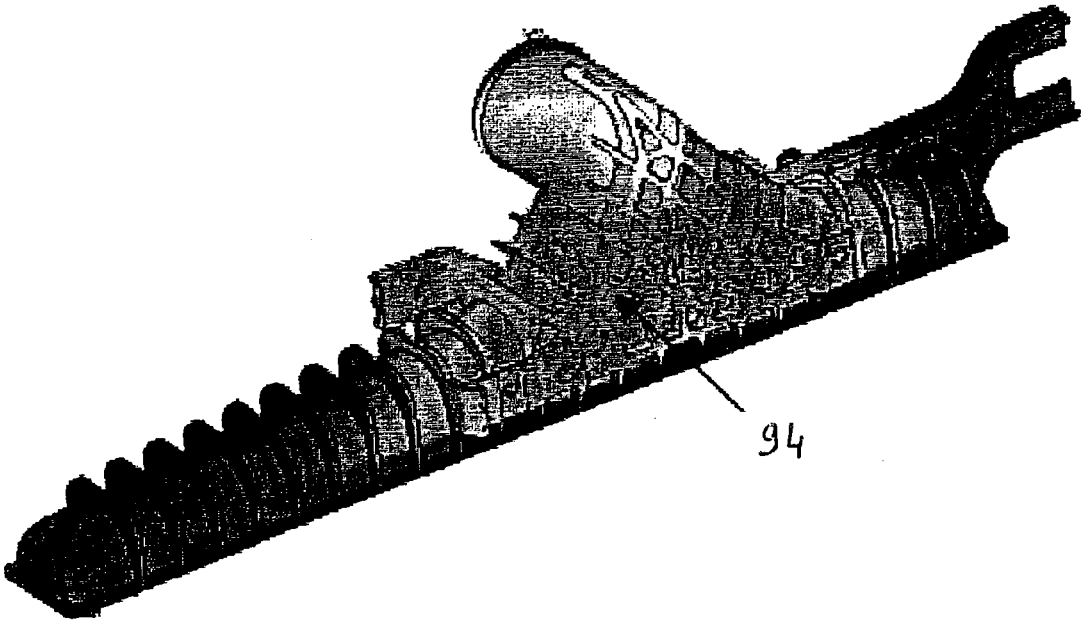

FIGS. 9*a* and 9*b* show FEA deformation results for comparing prior art design A to the rib pattern design B in accordance with an aspect of the present invention. A comparison of heat exchanger tank with angle rib design B 92 in accordance with the present invention, with prior art design A 91 under internal pressure loading, shows a reduction in maximum wall deflection of about 50% 94,93 (about 0.1 mm versus about 0.2 mm) for the angled rib design over the prior art design. Mounting brackets may or may not be included as elements that participate in reducing maximum wall deflection under internal pressure loading; however, in the embodiments in accordance with the present invention, the effect of using brackets versus non-use or alternative bracket uses appears not significant as it relates to the rib design.

Figure 10A:
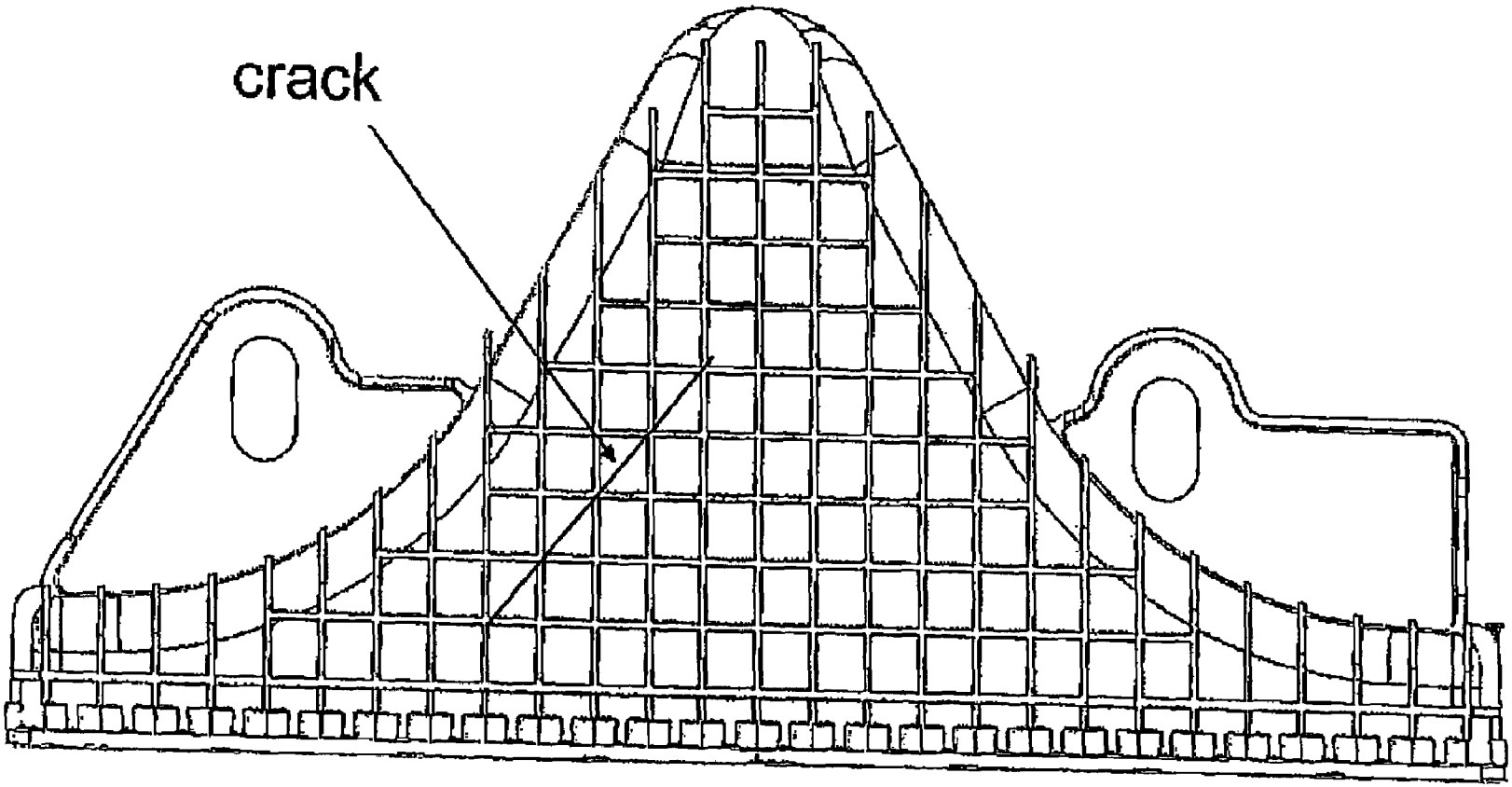
PRIOR ART FIG. 10a
FIGS. 10*a* and 10*b* Schematic representation of area of crack lines as found in prior art designs.
Figure 10B:
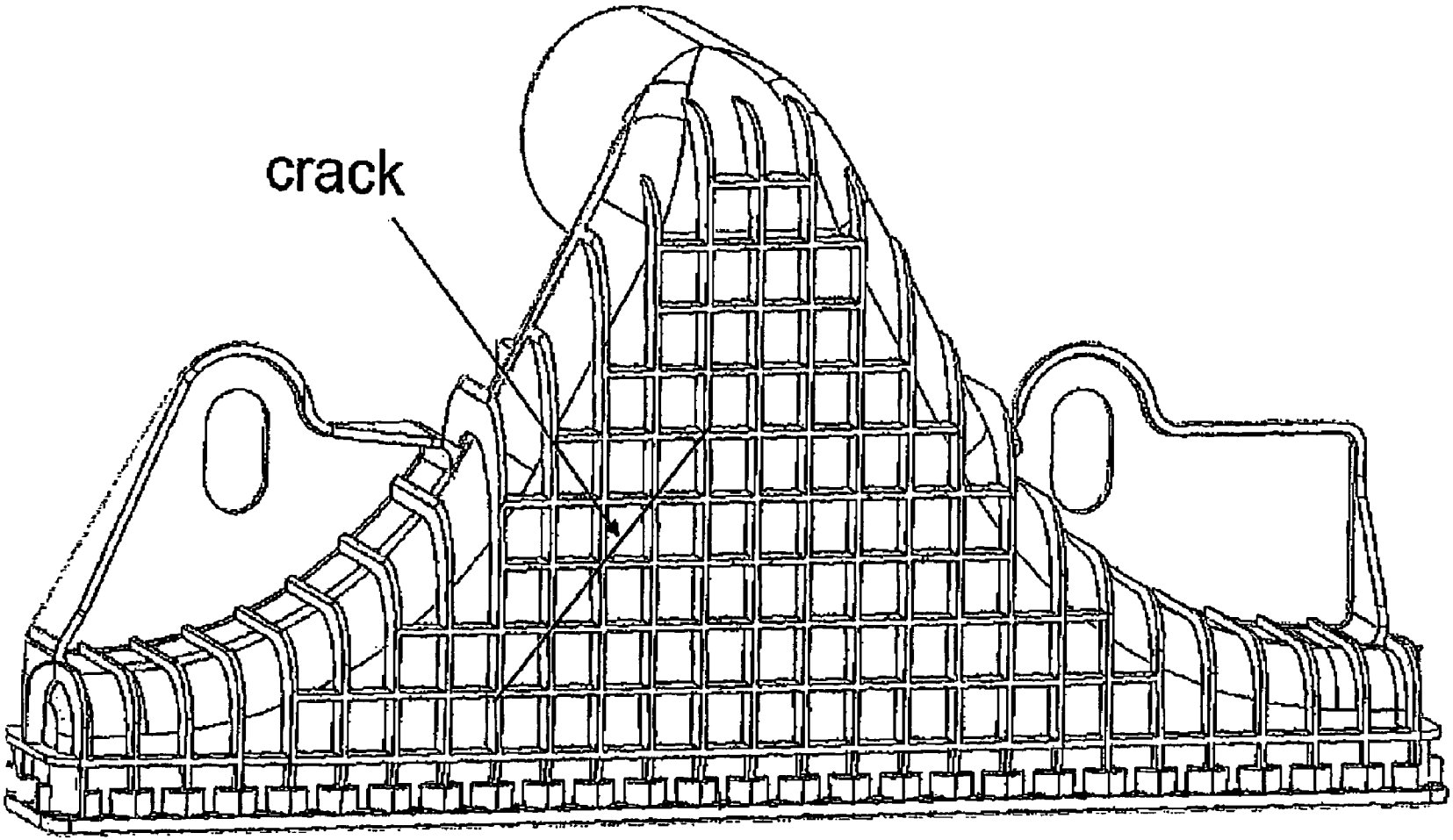
PRIOR ART FIG. 10b

FIGS. 10*a* and 10*b*, show a likely line of 'crack ' or 'fault' when utilizing a prior art example of a plastic heat exchanger tank under high pressure conditions with a 'rectangular' rib pattern.

Particularly advantageous are preferred embodiments of the present invention wherein the angled rib pattern is initiated at approximately the center of the sidewall. In a preferred embodiment of the present invention, internal ribs in the sidewall, in addition to the angled ribs, may be added with orientation based on a consideration of fluid flow as well as structural effects.

Also preferred are tanks that optimally comprise ribs on the top wall of the tanks. While principally useful in automotive heat exchanger tank application where prior art applies reinforcing ribs perpendicular and or parallel to the exit or entry plane of the tank header versus perpendicular to the local bending axis as provided by the present invention, the present invention may also be useful in other non-vehicular or stationary applications. An example of a use of one aspect of the present invention, could, therefore, be the employment of angled ribs in surge tanks and the like.

In preferred aspects of the present invention, tie bar or other complementary reinforcing features such as internal ribs, or rigid or semi-rigid boundaries, may be employed on or within the wall of the plastic tank part to further enhance the advantages the present invention provides.

The present invention also provides methods for making a heat exchanger, and, in particular, heat exchanger tank parts. In a preferred method of making a heat exchanger in accordance with an aspect of the present invention, a heat exchanger tank having angled ribs is made wherein synthetic resin or plastic or plastic-like materials have fibers or contour lines and is injected or otherwise formed make a heat exchanger tank so that the plastic or plastic like material flows such that the fibers are aligned to follow the flow along the line of the ribs.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A high pressure internal environment heat exchanger for use in automotive applications, comprising: a heat exchanger body part;

a heat exchanger tank part, and a plurality of ribs in a particular pattern; wherein the particular pattern of ribs is formed on the surface of the heat exchanger tank part on a wall section and is limited to a region covering between 5 to 50% of the total surface area of the heat exchanger tank part.

2. A heat exchanger as in claim 1, wherein the heat exchanger tank part is largely non-uniform in height and is comprised of synthetic resin or plastic or plastic like materials.

3. A heat exchanger as in claim 2, wherein the plurality of ribs follow heat exchanger tank part boundaries or structural features.

4. A heat exchanger as in claim 2, further comprising a header, defining a plane wherein the plurality of ribs are found in a non-uniform wall section of the heat exchanger tank part, and the angle between the header plane and the ribs is constantly changing across the non-uniform section of the heat exchanger tank part.

5. A heat exchanger, as in claim 4, wherein the heat exchanger tank part comprises external tank ribs.

6. A heat exchanger as in claim 3, wherein the heat exchanger tank part and the plurality of ribs are comprised of synthetic resin or plastic or plastic like materials.

7. A heat exchanger as in claim 5, wherein the wall profiles of the heat exchanger tank part are largely non-rectangular or non-square in shape.

8. A heat exchanger as in claim 7, wherein the general shape of the heat exchanger tank part is triangular or trapezoidal in shape.

9. A heat exchanger as in claim 8, wherein the heat exchanger is selected from the group consisting of charge air coolers, after coolers and inter coolers.

10. A heat exchanger as in claim 9, wherein the plurality of ribs forms two major sets of deflection iso-contours near the contour of the wall section of the heat exchanger tank part.

11. A heat exchanger as in claim 9, wherein the plurality of ribs forms a honeycomb type pattern; a second rib or plurality of ribs is perpendicular to the plane of the header; and a transition zone exists between the plurality of ribs and the second rib or plurality of ribs.

12. A heat exchanger as in claim 2, wherein the heat exchanger is selected from the group consisting of charge air coolers, after coolers and inter coolers.

13. A heat exchanger according to claim 6, wherein the heat exchanger is selected from the group consisting of charge air coolers, after coolers and inter coolers.

14. A heat exchanger according to claim 1 wherein the wall of the heat exchanger tank part having the plurality of ribs is taller near the neck than near other parts of the heat exchanger tank part, and where the plurality of ribs is approximately centered on the wall section of the heat exchange tank part.

15. A method of making a charge air cooler, after cooler or inter cooler heat exchanger having a heat exchanger tank having a plurality of ribs in a particular pattern by:

1) injecting or otherwise providing for synthetic resin or plastic or plastic-like materials having fibers or contour lines;

2) flowing the synthetic resin or plastic or plastic like material such that the fibers are aligned to follow the flow along the line of the ribs of the heat exchanger tank part;

3) allowing the synthetic resin or plastic or plastic like material to cure so that the heat exchanger tank part has external ribs that when assembled with a header, are non-perpendicular to the header plane in the wall section of the heat exchanger part tank; and, 4) assembling the heat exchanger tank part and the header together, thereby forming a heat exchanger having a largely triangular or trapezoidal heat exchanger tank of synthetic resin or plastic or plastic-like materials having fibers or contour lines.

* * * * *